US005571348A

United States Patent [19]

Yeh

[11] Patent Number: 5,571,348

[45] Date of Patent: Nov. 5, 1996

[54] METHOD AND APPARATUS FOR IMPROVING ALLOY PROPERTY AND PRODUCT PRODUCED THEREBY

[75] Inventor: Jien-Wei Yeh, Hsinchu, Taiwan

[73] Assignee: National Tsing Hua University, Taiwan

[21] Appl. No.: 348,131

[22] Filed: Nov. 23, 1994

Related U.S. Application Data

[63] Continuation of Ser. No. 18,191, Feb. 16, 1993, abandoned.

[51] Int. Cl.[6] ..... C22F 1/00

[52] U.S. Cl. ..... 148/559; 72/362; 72/363; 148/689; 148/692; 148/696; 420/590

[58] Field of Search ..... 148/689, 692, 148/696, 559; 420/590; 72/362, 363

[56] References Cited

U.S. PATENT DOCUMENTS 3,490,955 1/1970 Winter et al. ..... 148/692

4,737,340 4/1988 Dolgin ..... 420/590

FOREIGN PATENT DOCUMENTS 1661241 7/1991 U.S.S.R. ..... 148/696

*Primary Examiner*—David A. Simmons
*Assistant Examiner*—Robert R. Koehler
*Attorney, Agent, or Firm*—Fitzpatrick, Cella, Harper & Scinto

[57] ABSTRACT

A method for improving the properties of an alloy is provided. The method includes steps of a) preparing a raw alloy to be worked, b) providing a working apparatus, and c) repetitively kneading the raw alloy in the working apparatus until a desired property is achieved. The present invention also provides the working apparatus and discloses the product produced thereby.

8 Claims, 6 Drawing Sheets

METHOD AND APPARATUS FOR IMPROVING ALLOY PROPERTY AND PRODUCT PRODUCED THEREBY

This application is a continuation of application Ser. No. 08/018,191, filed Feb. 16, 1993, now abandoned.

BACKGROUND OF THE INVENTION

The present invention relates to a method or apparatus for improving alloy properties.

Despite strenuous effort made since 1970 to improve properties of alloys, including improving the conventional metallurgical processes, developing the rapid solidification process and developing the mechanically alloying process, the improvements achieved have not been without their own drawbacks. Specifically, in the conventional metallurgical process, raising the purity level or introducing the thermo-mechanical processing is costly and can only slightly improve the alloy property. The rapid solidification process must be combined with powder metallurgy in order to consolidate the resultant powder or thin ribbon into a bulk material. However, many costly extra steps (such as canning, degassing, pressing, hot working and decanning) are required in the powder metallurgy processing. Furthermore, a serious contamination and oxidation due to the high surface/volume ratio of the metallurgical powder is not easily avoidable and results in poor toughness and ductility. These shortcomings also arise through the mechanical alloying processing which must also be adopted in combination with powder metallurgy.

In order to dispense with the powder metallurgy processing, spray deposition, vacuum evaporation and layer deposition manufacturing processes based on rapid solidification have been developed to produce bulk materials directly which have a much finer grain size and microstructure. The spray deposition method creates a deposit of bulk material by impinging liquid jets or molten drops on a substrate. The vacuum evaporation heats the molten alloy in vacuum and condenses the vapor upon a substrate to build up a bulk material. The layer deposition results in a slab of material produced layer by layer by repetitively injecting a molten alloy drop onto a preheated anvil and then quenching it into a thin layer using a water-cooled copper hammer. These three methods, however, are susceptible of failure due to the formation of pores in the bulk material if the whole manufacturing process is not or cannot be controlled accurately.

The present invention results from the inventor's efforts to overcome the deficiencies of the prior art.

SUMMARY OF THE INVENTION

It is an object of the present invention to provide a general solution for overcoming the various deficiencies encountered by prior metallurgical technologies.

It is a further an object of the present invention to provide a method for improving the property of an alloy.

It is an additional an object of the present invention to provide an apparatus for improving the property of an alloy.

It is yet another object of the present invention to provide a alloy with improved properties.

According to the present invention, a method for improving properties of an alloy includes steps of (a) preparing a raw alloy to be worked, (b) providing a working apparatus, and (c) repetitively kneading the raw alloy in the apparatus until it has desired properties. Step (c) can be performed by alternately subjecting the alloy to force applied from different directions, or by repetitively passing the raw alloy through at least one relatively small passage of the working apparatus. The present method can further have a step of (d) preheating the raw alloy to a suitable softening temperature before the step (c). Step (a) can further include sub-steps of preparing first component layers, preparing second component layers; and alternately stacking the first and second component layers in the working apparatus. Certainly, step (a) can be a step of preparing an alloy ingot. Alternatively, step (a) can include sub-steps of preparing the rapidly-solidified alloy layers or powder and stacking the layers or inserting the powdery alloy in the apparatus.

An apparatus for improving properties of an alloy includes an extruding vessel capable of receiving therein a raw alloy to be worked, and an extruding device connected to the extruding vessel which allows the raw alloy to be compressed or expanded from different directions. The vessel can be a cylindrical member having a first end, an intermediate portion and a opposite to the first end second end. The member can, alternatively, consist of two cylindrical counterparts. Of course, the vessel can further include an extruding die mounted in the intermediate portion and having at least a relatively small passage means, such as a slit or a hole. The extruding device can include a pair of extruding plungers capable of alternately, coaxially, oppositely and reciprocatingly working the raw alloy in the vessel and both having opposing first and second ends. The extruding device can further include two dummy blocks respectively attached to the first ends and capable of avoiding the direct contact of the first ends, and two rams respectively connected with the second ends and driven by two cylinder bodies respectively. A property-improved alloy according to the present invention is produced by steps of preparing a raw alloy to be worked, and repetitively kneading the raw alloy until the properties desired thereof are achieved. The raw alloy can be an alloy ingot, can include alloy layers produced by a rapid solidification method, can be a compacted article of metal powders, or can include alternately stacked layers of at least two pure elements or other components of materials.

BRIEF DESCRIPTION OF THE DRAWING

The present invention may best be understood through the following description with reference to the accompanying drawings, in which.

DETAILED DESCRIPTION OF THE PREFERRED EMBODIMENT

Figure 1:
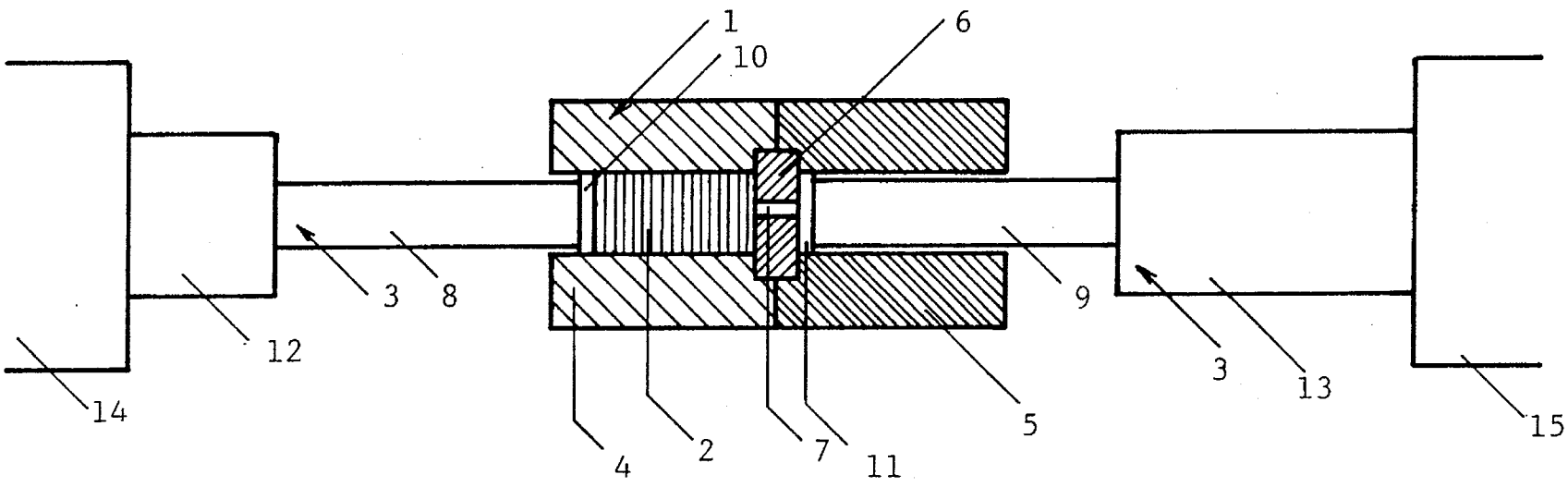
FIG. 1 is a schematical view showing a preferred embodiment of a working apparatus for improving the properties of an alloy according to the present invention.

Referring now to FIG. 1, an apparatus for improving the alloy property according to the present invention includes an extruding vessel 1 capable of receiving therein a raw alloy 2 to be worked, and an extruding device 3 connected to vessel 1 to allow alloy 2 to receive forces applied from different directions. Vessel 1 can include a left counterpart 4, a right counterpart 5 and a middle die 6 having at least one relatively small passage means 7, such as a slit or a hole.

Extruding device 3 can include a pair of extruding plungers 8, 9 respectively capable of alternately, coaxially, oppositely and reciprocatingly working alloy 2, two dummy blocks 10, 11 respectively attached to free ends of plungers 8, 9, two rams 12, 13 respectively connected to the other ends of plungers 8, 9 and two oil cylinder bodies 14, 15 respectively receiving therein and driving rams 12, 13.

In order to examine the theory of the present invention, experiments were conducted in a specific working apparatus according to the present invention in which counterparts 4, 5 each have lengths of 80 mm and diameters of 20 mm, die 6 has a passage means 7 of a single hole having a diameter of 6.3 mm, and plungers 8, 9 have a length of 110 mm, a diameter of 20 mm and a maximum oil pressure 100 kg/cm$^2$.

The experiments utilized the following procedures: placing the raw alloy 2 to be worked into counterpart 4, heating alloy 2 to a desired operating temperature, extruding heated alloy 2 through die 6 at a speed of 1 cm/sec using plunger 8 at about a 90 kg/cm$^2$ extruding pressure and expanding alloy 2 in counterpart 5 under the conditions of applying back pressure on plunger 9 of about 40 kg/cm$^2$, and then extruding again the extruded alloy 2 from counterpart 5 to counterpart 4 after exchanging the pressures on plungers 8, 9. Such procedures are consecutively and repetitively executed to the satisfaction of the artisan. (The extrusion times mentioned hereinafter is defined as the number of times raw alloy 2 has passed through die 6.)

Raw alloys 2 which are subjected to the above experimental procedures include alternately stacked pure lead and tin layers of 0.3 mm thickness, the Pb-50 vol pct Sn (in which "vol pct" stands for volume percentage) ingot, rapidly solidified Al-12 wt pct Si layer (in which "wt pct" stands for weight percentage), the conventional ingot-processed Al-12 wt pct Si alloy, the rapidly solidified A1-20 wt pct Si layers, and the A1-20 wt pct Si ingot. The following results are found:

1) The present reciprocating extrusion process can successfully knead and consolidate stacked layers of pure Pb and Sn into the Pb-50 vol pct Sn alloy having a fine and uniform distribution of the two phases.
2) The present process can also be used to knead the Pb-50 vol pct Sn alloy ingot to have a microstructure very similar to that of kneaded stacked layers.
3) The present method can also successfully consolidate and knead the Al-12 wt pct Si alloy or A1-20 wt pct Si alloy layers produced by the hammer-and-anvil method. The interfaces between layers have been welded up and the Si particles have been uniformly distributed. The mechanical properties thereof can be improved until a limit is reached.
4) The present method can also be used to knead the Al-12 wt pct Si or A1-20 wt pct Si alloy ingots. Plate-like eutectic Si particles and large primary Si crystals have been refined to a certain degree. The mechanical property thereof can be significantly improved until a limit is attained.
5) The rapidly solidified A1-Si alloys consolidated and kneaded by the present reciprocating extrusion have been proven to be superior in microstructures and properties to the alloy ingots kneaded by the same process. This is attributable to the much finer distribution of Si particles possessed by rapidly solidified alloys.

The effectiveness of the present invention can be illustrated by the following descriptions with reference to the diagrams shown in FIGS. 2–11.

Figure 2:
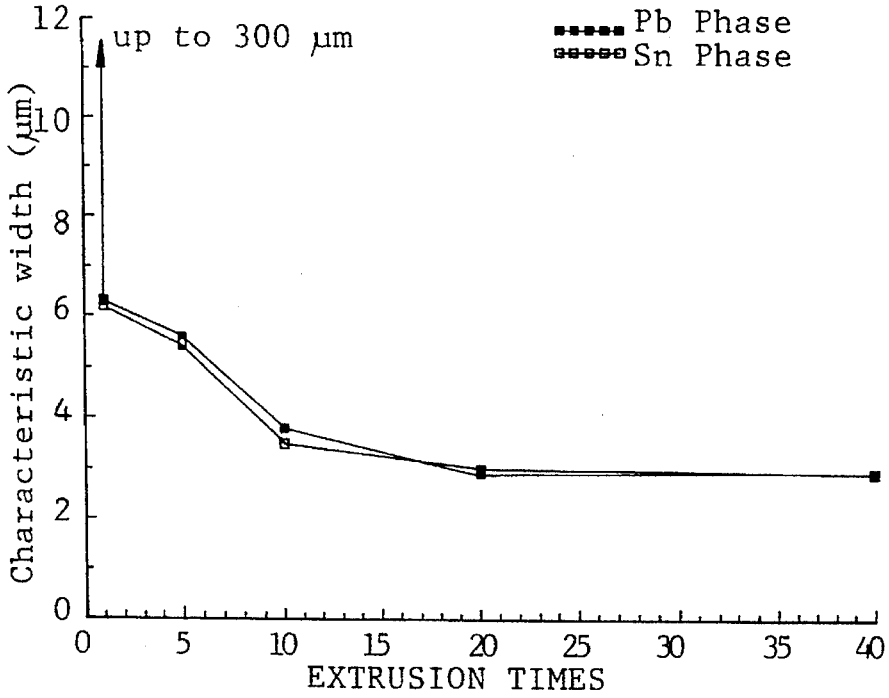
FIG. 2 is a diagram showing the characteristic width of the Pb phase and Sn phase in stack of layers as a function of extrusion times according to the present invention.
Figure 3:
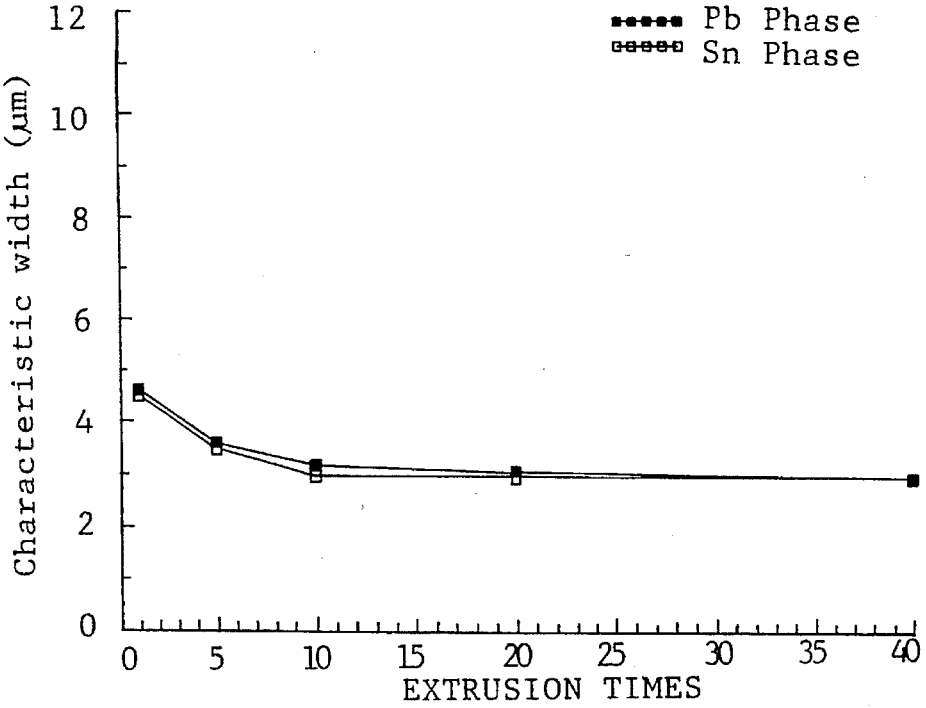
FIG. 3 is a diagram showing the characteristic width of the Pb phase and Sn phase in Pb—Sn alloy ingot as a function of extrusion times according to the present invention.

FIG. 2 is a diagram showing the characteristic width of Pb phase and Sn phase in stack layers as a function of extrusion times, which shows that the widths decrease quickly during the initial few times of repeated extrusion. After 10 times, Pb and Sn phases can respectively attain widths of 3.8 μm and 3.5 μm. FIG. 3 shows that the Pb (Sn) phase particle size in ingot is refined from 4.6 (4.5) μm for the first extrusion to about 3.6 (3.5) μm in average after 5-time extrusion.

Figure 4:
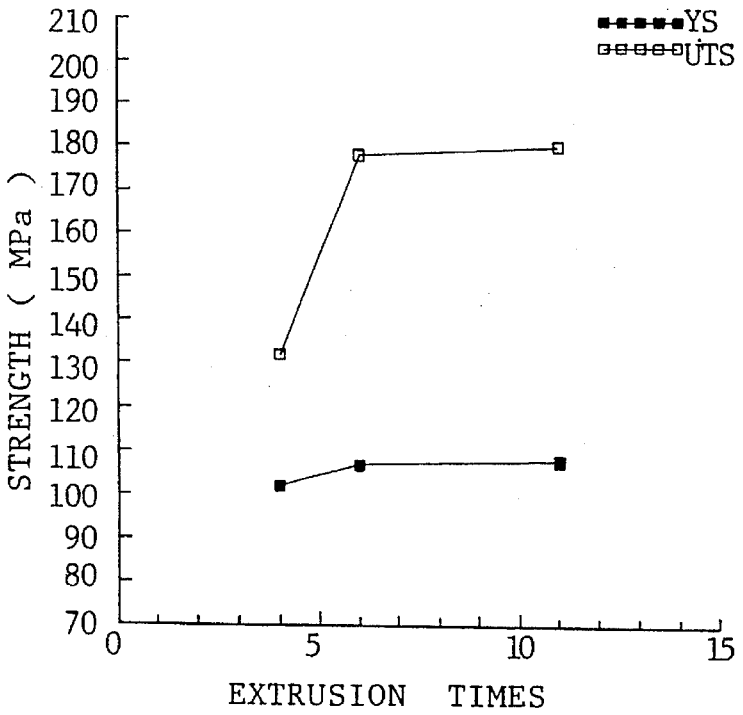
FIG. 4 is a diagram showing the effect of repeated extrusion times on the strength of the rapidly-solidified Al-12 wt pct Si alloy according to the present invention.
Figure 5:
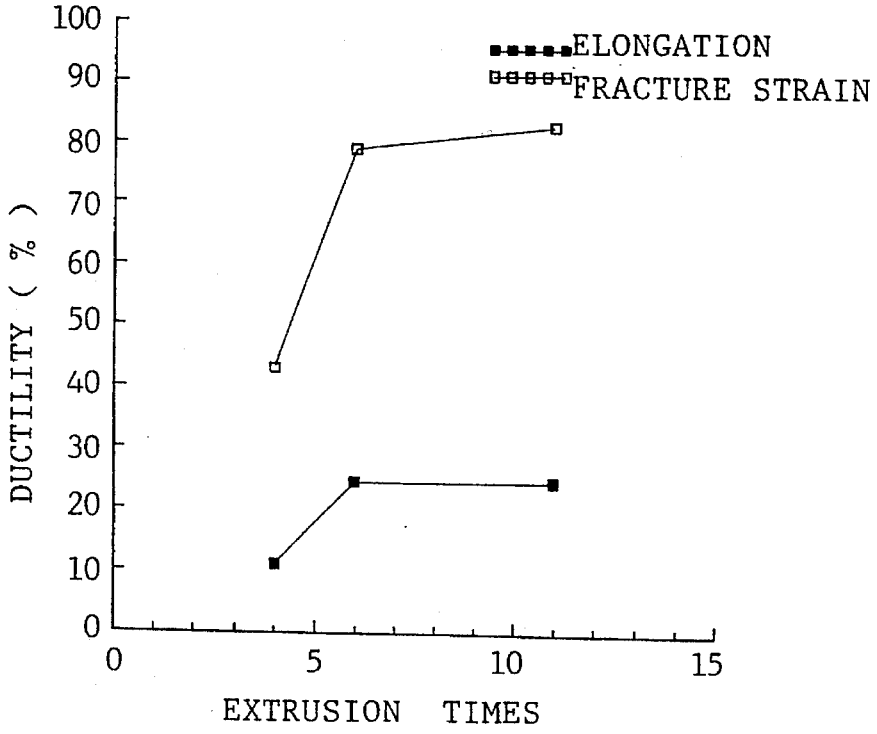
FIG. 5 is a diagram showing the effect of repeated extrusion times on the ductility of the rapidly-solidified Al-12 wt pct Si alloy according to the present invention.

FIGS. 4 and 5 show that as the number of the extrusion time is increased,the mechanical properties of the rapidly solidified Al-12 wt pct Si alloy are all improved. Comparing the 4-time condition and the 11-time condition, it is found that the fracturing strain and the elongation are respectively improved by 93% and 123% while the yield strength and the ultimate tensile strength are respectively increased with 6% and 36%.

The improvement of ductility is attributed to the elimination of interfaces between layers and the uniform distribution of silicon particles. Since the interface originally consists of the oxide film and pores, it retards the bonding between layers, which in turn results in a very poor alloy ductility. As the repeated extrusion is applied for kneading the alloy, the oxide film will break to expose fresh metal suitable for optional welding. In addition, pores will also be closed up under the high pressure. Consequently, the repeated extrusion will restore the alloy ductility to a high level after the metal welding and the pore closing up occur. Apparently the extent of restoration still depends on the degree of welding completeness which is increased with the increase of the repeated extrusion time. Furthermore, the uniformity of particles distribution is also thought to be important for a good ductility. If Si particles distribute non-uniformly, the region with the higher volume proportion of particles will fracture more easily than the region with low density.

Figure 6:
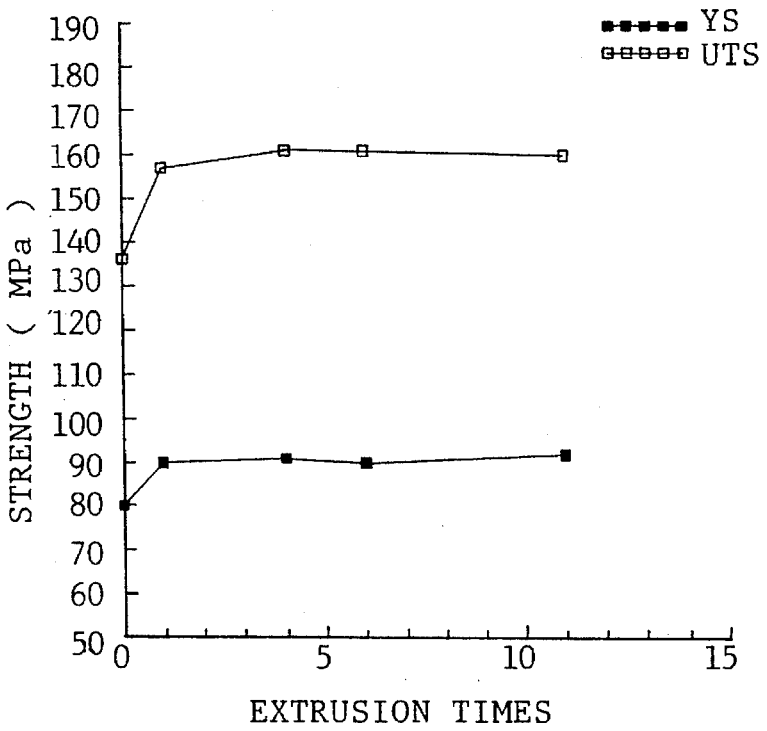
FIG. 6 is a diagram showing the effect of repeated extrusion times on the strength of the ingot-processed Al-12 wt pct Si alloy according to the present invention.
Figure 7:
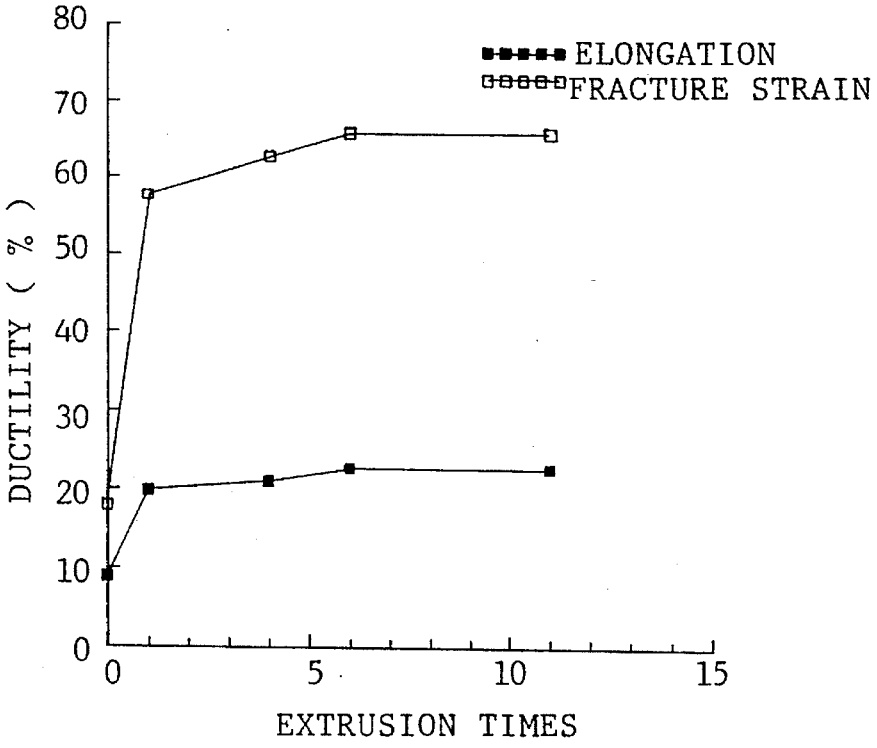
FIG. 7 is a diagram showing the effect of repeated extrusion times on the ductility of the ingot-processed Al-12 wt pct Si alloy according to the present invention.

FIGS. 6 & 7 show that as the repeated extrusion continues, the mechanical properties of the ingot-processed Al-12 wt pct Si alloy are all improved, and that a remarkable improvement of the properties by the first-time extrusion can be obtained but a small improvement for more times. The fracture strain and elongation are respectively improved by 15% and 14% from the first time to 11 times of extrusion by which the yield strength and the ultimate strength are both improved by 2%. The remarkable improvement by the first time extrusion is attributed to the great reduction in the length of plate-like Si particles, whereas the small improvement in mechanical properties occurred thereafter is obviously due to the slight refining of silicon particles as revealed by the microstructure.

Figure 8:
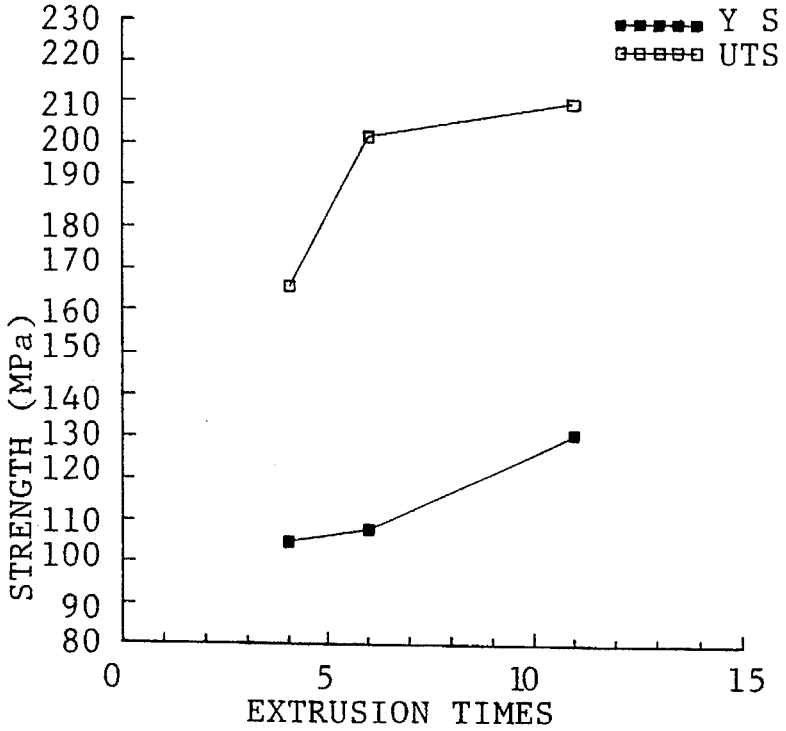
FIG. 8 is a diagram showing the effect of repeated extrusion times on the strength of the rapidly-solidified A1-20 wt pct Si alloy according to the present invention.
Figure 9:
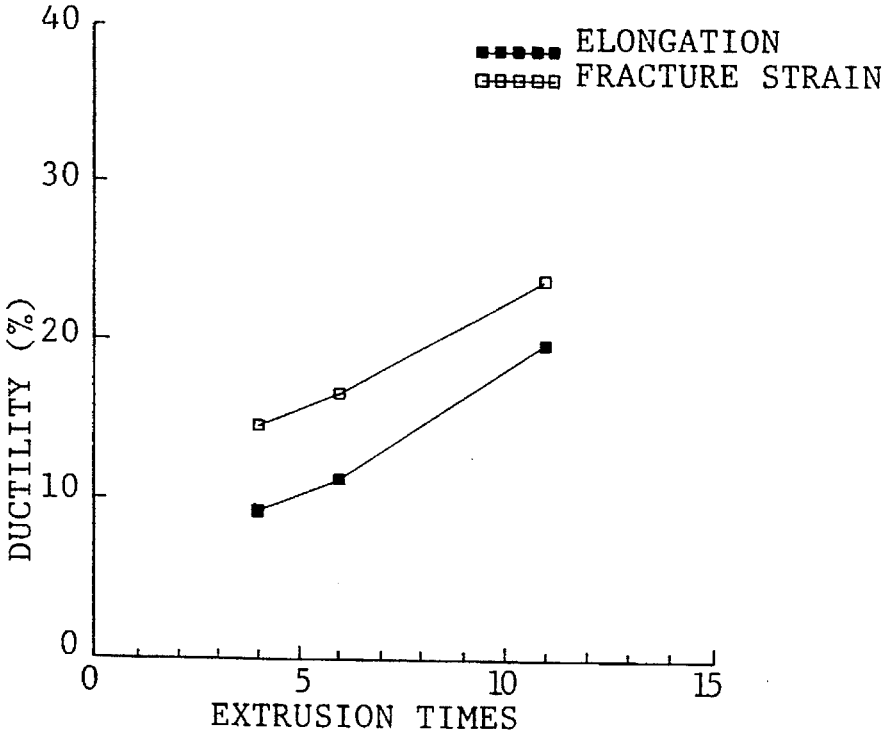
FIG. 9 is a diagram showing the effect of repeated extrusion times on the ductlilty of the rapidly-solidified A1-20 wt pct Si alloy according to the present invention.

FIGS. 8 & 9 show that as the extrusion proceeds further the mechanical properties of the rapidly solidified Al-20 wt pct Si alloy are all improved. It is noticed that the fracture strain and the elongation are respectively improved by 63% and 114% from the 4-time extrusion to the 11-time extrusion. This large improvement is attributed to the welding of interfaces between layers. From the microstructure examination, the interfaces are completely eliminated after 11 times of extrusion. As the number of the extrusion time is increased, the tensile strength and the yield strength can respectively be enhanced by 25% and 27%.

Figure 10:
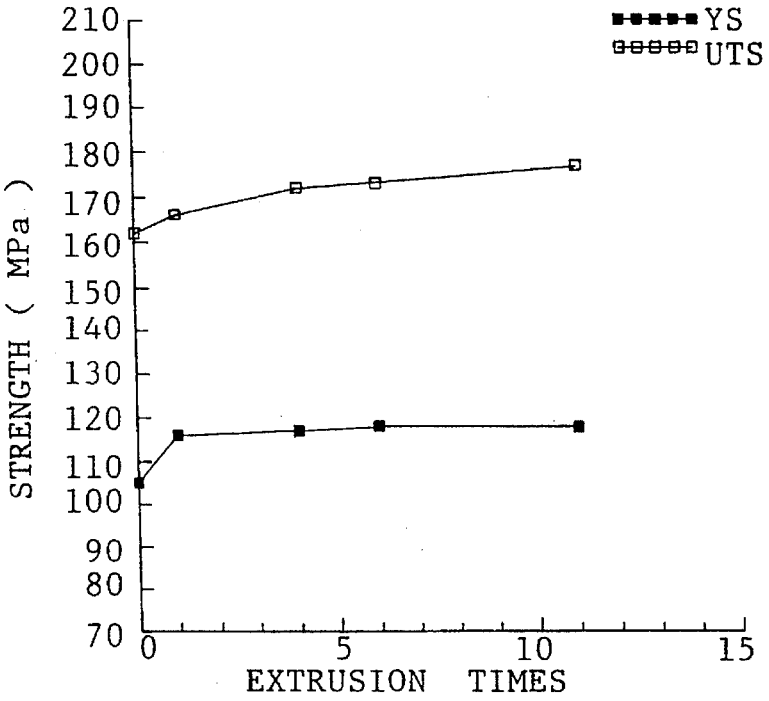
FIG. 10 is a diagram showing the effect of repeated extrusion times on the strength of the ingot-processed A1-20 wt pct Si alloy according to the present invention.
Figure 11:
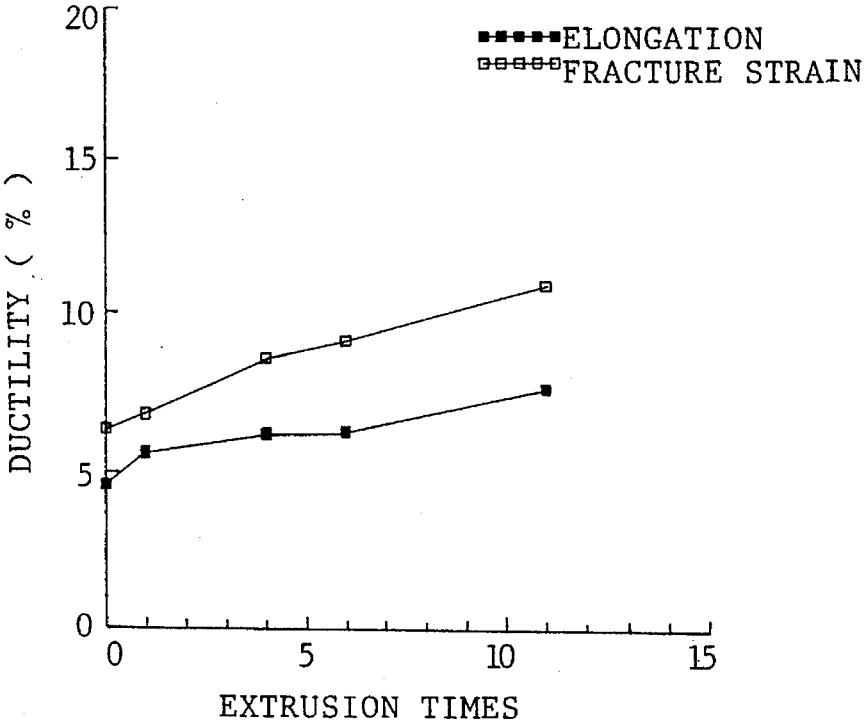
FIG. 11 is a diagram showing the effect of repeated extrusion times on the ductility of the ingot-processed A1-20 wt pct Si alloy according to the present invention.

FIGS. 10 & 11 show that the properties of the ingot-processed A1-20 wt pct Si alloy are improved as the extrusion is increased in time. The yield strength increases significantly while other properties increase slightly for the first extrusion. The strengthening of the alloy is due to the large refining of the eutectic Si phase. Since the primary Si phase is still in a large size, the ductility, the fracture strain, and the ultimate tensile strength are not effectively increased. After the first extrusion, the yield strength is almost not improved but the other three properties increase gradually. The fracture strain and the elongation are respectively improved by 61.8% and 37.5% from the first extrusion to the 11-time extrusion and the ultimate tensile strength is increased with 7%. This is reasonable because although eutectic Si particles are not effectively refined after the first time extrusion, the primary Si crystals are broken gradually into smaller particles which is helpful for improving the ductility.

It is to be noticed that the term, "alloy", used throughout this specification is only illustrative but not limitative. For example, the present invention can equally be successfully used to uniformly mix/blend the polymer, ceramics and/or plastics . . . etc. to form a product of a singular or composite basic material. Additionally, as is readily apparent to those skilled in the art, various modifications to the above described embodiments, which modifications are not considered to be capable of departing from the spirit and scope of the present invention as recited in the appended claims.

What we claim is:

1. A method for improving properties of an alloy comprising steps of:

(a) selecting a raw alloy from the group consisting of an ingot, alloy layers, compacted metal powder, and stacks of at least two pure elements;

(b) providing a working apparatus for working said raw alloy, said working apparatus comprising a first extruding vessel, a second extruding vessel and an extruding die therebetween, said extruding die having a small passage, said small passage being a slit or a hole;

(c) preheating said raw alloy to a softening temperature to create a pre-heated raw alloy; and (d) repetitively kneading said pre-heated raw alloy to a desired extent in said working apparatus by reciprocatingly passing said raw alloy through said small passage between said first and second extruding vessels.

2. A method according to claim 1 wherein said repetitive kneading step d) is performed by allowing said raw alloy to be alternately force-applied from different directions.

3. A method according to claim 1 wherein said raw alloy is prepared by (i) preparing first component layers;

(ii) preparing second component layers; and (iii) alternately stacking said first and second component layers.

4. A method according to claim 1 wherein said raw alloy is an alloy ingot.

5. A method according to claim 1 wherein said raw alloy is prepared by (1) preparing alloy layers; and (2) stacking said layers.

6. A method according to claim 5 wherein said alloy layers are produced by a rapid solidification.

7. A method according to claim 1, wherein the size of said small passage is substantially smaller than the size of said raw alloy.

8. A method according to claim 1, wherein said small passage has a diameter of 6.3 mm.

* * * * *

UNITED STATES PATENT AND TRADEMARK OFFICE

CERTIFICATE OF CORRECTION

PATENT NO. : 5,571,348

DATED : November 5, 1996

INVENTOR(S) : JIEN-WEI YEH

It is certified that error appears in the above-identified patent and that said Letters Patent is hereby corrected as shown below:

COLUMN 1

Line 45, "of" should read --to--.
Line 56, "an" should be deleted.
Line 58, "an" (second occurrence) should be deleted.
Line 61, "a" should read --an--.
Line 67, "desired" should read --the desired--.

COLUMN 2

Line 4, "(d)" should be deleted.
Line 20, "a opposite" should read --a second end opposite-- and "end second" should read --end.--.
Line 21, "end." should be deleted.
Line 33, "A" should read --¶ A--.
Line 42, "DRAWING" should read --DRAWINGS--.

COLUMN 3

Line 56, "are" should read --were--.

COLUMN 4

Line 38, "increased,the" should read --increased, the --.
Line 43, "with" should read --by--.
Line 52, "optional" should read --optimal--.

UNITED STATES PATENT AND TRADEMARK OFFICE

CERTIFICATE OF CORRECTION

PATENT NO. : 5,571,348

DATED : November 5, 1996

INVENTOR(S) : JIEN-WEI YEH

It is certified that error appears in the above-identified patent and that said Letters Patent is hereby corrected as shown below:

COLUMN 5

Line 11, "further" should read --further,--.
Line 35, "with" should read --by--.

COLUMN 6

Line 23, "step d)" should read --step (d)--.
Line 26, "by" should read --by:--.

UNITED STATES PATENT AND TRADEMARK OFFICE

CERTIFICATE OF CORRECTION

PATENT NO. : 5,571,348

DATED : November 5, 1996

INVENTOR(S) : YEH

It is certified that error appears in the above-identified patent and that said Letters Patent is hereby corrected as shown below:

COLUMN 6 (cont'd)

Line 34, "by" should read --by:--.

Signed and Sealed this

Fifteenth Day of April, 1997

Bruce Lehman

*Attest:*

BRUCE LEHMAN

*Attesting Officer*

*Commissioner of Patents and Trademarks*